US006490742B2

(12) United States Patent
Hall et al.

(10) Patent No.: US 6,490,742 B2
(45) Date of Patent: Dec. 10, 2002

(54) SUPPORTS FOR APPENDAGES

(76) Inventors: Toni Hall, 1323 S. Jackson, L.R., AR (US) 72204; Ronald Hall, 1614 W. 21st St., Little Rock, AR (US) 72202; Edwina Conley, 5135 Barrocuda Ct., Waldorf, MD (US) 20603; Jerome Raynor, 425 W. 32rd St., Little Rock, AR (US) 72206

( * ) Notice: Subject to any disclaimer, the term of this patent is extended or adjusted under 35 U.S.C. 154(b) by 0 days.

(21) Appl. No.: 09/727,885

(22) Filed: Dec. 1, 2000

(65) Prior Publication Data

US 2002/0095731 A1 Jul. 25, 2002

(51) Int. Cl.[7] ..... A61G 7/065

(52) U.S. Cl. ..... 5/630; 5/640; 5/648; 5/646; 5/657; 128/845

(58) Field of Search ..... 128/878, 882, 128/845; 5/630, 640, 646, 648, 651, 652, 655.9, 657

(56) References Cited

U.S. PATENT DOCUMENTS

| | | | | | |
|---|---|---|---|---|---|
| 1,973,240 | A | * | 9/1934 | Werness et al. | 27/13 |
| 2,795,838 | A | * | 6/1957 | McNeely | 27/21.1 |
| 3,234,623 | A | * | 2/1966 | Rector | 248/118 |
| 4,270,235 | A | * | 6/1981 | Gutmann | 5/646 |
| 6,154,905 | A | * | 12/2000 | Frydman | 128/845 |
| 6,182,314 | B1 | * | 2/2001 | Frydman | 128/845 |

* cited by examiner

*Primary Examiner*—Michael F. Trettel
(74) *Attorney, Agent, or Firm*—Joe D. Calhoun

(57) ABSTRACT

A support for an appendage comprising a plurality of stackable bolsters in which mating surfaces are engaged to provide both frictional and lateral support between adjacent bolsters to stabilize the support.

15 Claims, 4 Drawing Sheets

SUPPORTS FOR APPENDAGES

TECHNICAL BACKGROUND OF THE INVENTION

1. Field of the Invention

The present invention relates generally to support apparatus intended primarily, although perhaps not exclusively, for use in the medical field for support of body appendages such as arms and legs, especially during dressing changes or wound treatment.

Whether in the surgical theater or during convalescence or wound care, proper support of a patient's arm or leg is particularly crucial, especially when the injury or disease is in the appendage to be supported. Appropriate support must be capable of positioning the appendage at the proper elevation, taking into account the comfort of the patient and balancing that with the requirements of the attending heath care provider or other personnel. Additionally, a proper support must be versatile in that the area in contact with the skin of the patient must not be abrasive or allergenic, and the area in contact with the skin should be sufficiently exposed to enhance healing.

The invention disclosed herein is a new concept that solves a problem and fulfills a need. Its primary function is to aid in dressing changes of extremities. It can be used to aid in cast removal, Ace bandage wrap therapy, application of ted hose, and assist in therapeutic massage.

2. Related Art

Prior art efforts at developing devices to provide the necessary appendage support are many and varied, which in and of itself is mute evidence of the lack of satisfactory resolution.

Several such devices include a support device disposed on a telescoping stand, among them Astroff U.S. Pat. No. 2,732,269 wherein a "U" shaped tray is supported on a telescoping pole. In a similar manner, Malerich Jr. U.S. Pat. No. 2,871,074 in which a table top is supported on a telescoping standard. A base includes a caster or wheel to permit the device to be easily moved from place to place. Eubanks, Sr. U.S. Pat. No. 2,630,288 has a large "U" shaped adjustable frame on a telescoping pole.

Some devices are specifically focused on operating theater use, such as, e.g., Craven Jr. U.S. Pat. No. 4,602,773 and Adams U.S. Pat. No. 2,801,142, which discloses a device that actually attaches to an operating table. The arm support of Aydt U.S. Pat. No. 3,528,413 is attachable to, for example, a bed rail.

Whitt devised, and patented a stantion U.S. Pat. No. (4,373,709) which positions a limb for surgery, and is attachable to an operating table, and, while no patent was found on the device, the ever present stirrup is well known in the industry for supporting the foot in a predetermined position.

Inherent in all such devices in which a pole, or the like, whether telescoping or not, and irrespective of the size of the base, tend to provide, to a greater or lesser degree, wobble. That is, there is an instability which tends to permit movement of a person's appendage left or right, front to back or a combinations of both, which is exacerbate by the size and/or weight of the individual limb or appendage. Such movement, no matter how slight, could have disastrous side effects to the individual that is depending on the device for support.

In yet another category, there are limb supporting devices using a scissor type device, as distinguished from the telescoping standard, to raise and lower a support device. Among these devices are Richards U.S. Pat. No. 2,502,752 and Nygard U.S. Pat. No. 2,551,386.

Unfortunately, such devices become increasingly unstable as the scissor device is expanded, and, further, such devices have a tendency to be unsafe in that clothing, sheets and the like tend to get caught in the scissoring action.

Also in commerce is a product called the Contour Leg Pillow, sold by a company named ComfortTrac (in Charlotte, N.C.). That product may be seen at www.contourcloud.com/Legpillow.htm. That pillow is designed to be held between two legs, but is not designed to support an appendage in any particular position. Nor is that product designed to be stackable, or otherwise capable of supporting an appendage at a desired height.

Virtually all of these devices tend to be both complex and costly, and none are particularly suited for convalescence in other than a carefully monitored setting such as in a hospital or the like, and even then there is sufficient room for error as to pose a danger of sorts to the person who relies on the device for support.

SUMMARY OF THE INVENTION

The support device which is at the heart of the present invention represents a simple, yet safe and effective alternative to devices of the prior art.

In contradistinction to the conventional logic that says that stability can only be achieved by an expensive and bulky metal contrivance, often anchored to a bed or gurney, comfort and support can be achieved without the necessity of providing a device that requires an engineer to operate. The invention disclosed herein may be used almost anywhere, and for a wide variety of purposes. One application is for temporary use during dressing changes or other wound care. This invention, known as Toni's T-Support, often reduces the number of health care personnel needed to perform many tasks; it often allows one person to accomplish health care tasks herertofore usually requiring at least two people to perform. Two-person tasks waste valuable labor, and can be accomplished using this invention without causing strain to the patient or caregiver. Moreover, the invention promotes good body mechanics by elevating affected areas to desired height.

A common problem with bed bound patients is decubitus on the heel. Since the heel is not always easily accessible, care often requires two caregivers, again squandering valuable labor time.

The invention disclosed herein is relatively stable, even when used on a bed or examination table. The stackable version is especially stable when used on the floor or similar stable surface.

It is, therefore, an objective of the present invention to provide a simple, yet entirely effective, support device which permits proper elevation to be established, while providing comfort and stability for the patient.

Another objective, related to the foregoing, is to provide optimum support for a person's appendage which is effective, yet simple to use and store when not in use.

A further objective is to provide a support of the type referenced herein that is affordably usable in a hospital or other health care facility, at home, or virtually any setting with equal effectiveness.

A still further objective is to provide a support device that does not rely on mechanical contrivances such as telescoping poles, clamps, wing nuts, worm screws, scissoring devices, nuts and bolts; does not significantly wear over time, and is readily transportable from use to use, all in a device which is highly stable irrespective of height.

The foregoing, as well as other objects and advantages of the present invention will become apparent to one skilled in the art when the detailed description of a preferred embodiment is taken in conjunction with the appended drawing, in which:

DETAILED DESCRIPTION OF THE INVENTION

Figure 1:
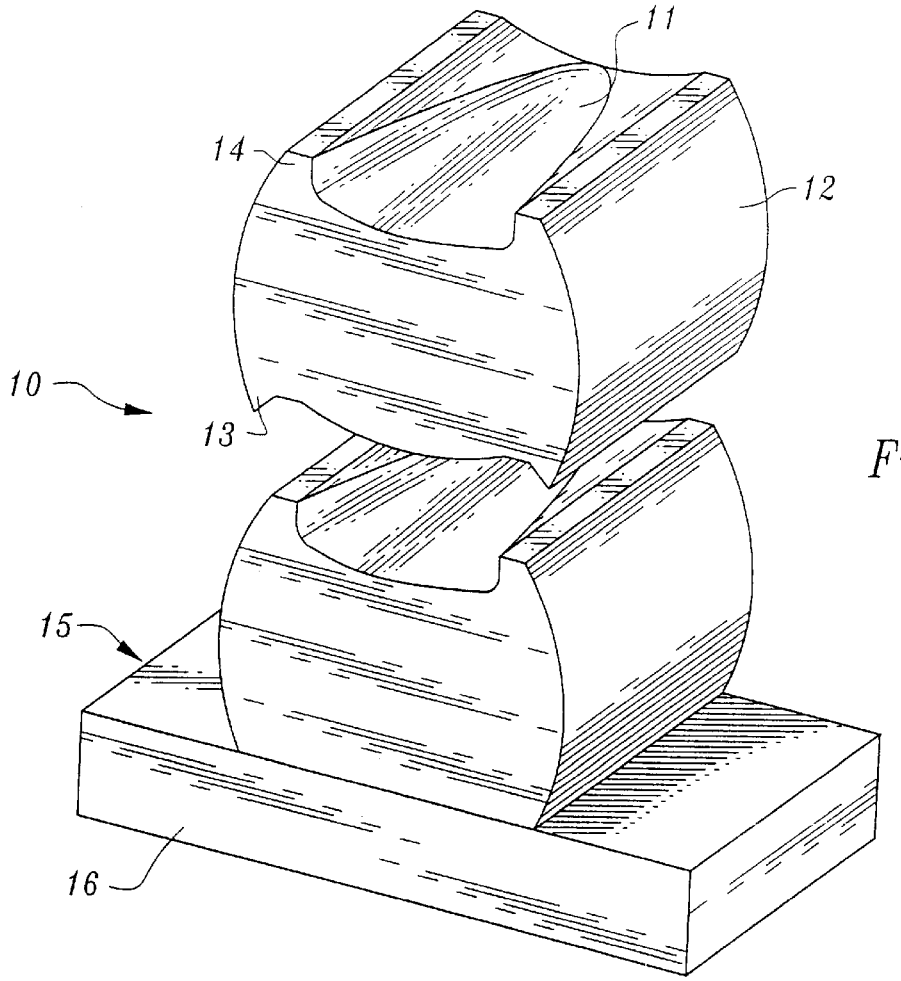
FIG. 1 is a pictorial view of a device constructed in accordance with the present invention, shown in perspective, with an apical support member (10) almost in position to stack atop a basal support member (15) including aplanar base (16) having a plurality of lateral dimensions exceeding the lateral dimensions of said lateral sides of said support member. Note the parabolic indentation (11) in the upper surface of each support member; the lateral sides (12) having curvature essentially convex to a common longitudinal axis; the lowermost downstanding lateral margins (13) and the uppermost upstanding lateral margins (14), each of said downstanding lateral margins adapted to essentially overlay said uppermost lateral margin of an apical support member for frictional mating engagement and lateral support.

In its most general form, the appendage support device described herein comprises a plurality of essentially stackable support members, each having an upper surface and a lower surface and at least two essentially opposite lateral sides. Each of said upper surfaces is adapted to mate in frictional engagement with a lower surface of an adjacent support member, facilitating the stacking of at least one apical support member atop at least one basal support member. Each of said support members also has means on said lower surface for providing lateral support between itself and said basal support member.

Another version of the invention further comprises at least two essentially opposite longitudinal ends. In this version, each of the lateral sides include curvature essentially convex to a common longitudinal axis of said support member, with each of said convex lateral sides having a lowermost downstanding lateral margin and an uppermost upstanding lateral margin. Each of said downstanding lateral margins is adapted to essentially overlay said uppermost lateral margin of an apical support member for said frictional mating engagement and said lateral support.

In another version of the invention, each of said upstanding lateral margins has an essentially horizontal upper face. Moreover, each of said lower surfaces is adapted to facilitate frictional mating engagement with said upstanding horizontal marginal face of an apical support member.

In another version of the invention, at least an uppermost of said apical support members has an upper surface defining a regional concavity ergonomically sized to accept an appendage for support. Said ergonomic sizing may include an essentially parabolic indentation, the apex of said parabolic indentation terminating at one longitudinal end of said support member and almost flush with said uppermost upstanding margin; said parabolic indentation essentially deepens and widens while transversing along said longitudinal axis to an opposite longitudinal end of said support member.

A more specific version of the appendage support device further comprises a basal-most support member having a lower face comprising a plurality of downstanding touchpoints of suitable length to allow said basal support member to rest at an optimal orientation upon substratum. Said touchpoints may essentially form an essentially planar base. One optional version allows the periphery of said planar base to extend past than the lateral sides of its connected support member, thereby providing stability against lateral tilting of the support device when in use. Another optional version includes having a plurality of lateral dimensions exceeding the lateral dimensions of said lateral sides of said support member, so that the base provides stability against tilting in any direction. This version may also include upstanding perimeter margins defining a reservoir, for retaining fluids or other materials encountered during use of the device. The reservoir may also be sized to accept an irrigation tray.

Although the appendage support device may be made of any construction materials accomplishing the support function, particular construction materials may be selected from the group of firm foam material or rigid plastic or other polymeric material, and combinations thereof.

A more specific embodiment includes an appendage support device wherein each of said support members has:

- a longitudinal dimension in the range of between about 4 inches and 24 inches long;
- a vertical height in the range of between about 4 inches and 10 inches; and
- a width in the range of between about 4 inches and 10 inches.

More particularly, each of said support members has:

- a longitudinal dimension of about 6 inches;
- a vertical height of about 5 inches; and
- a width of about 8 inches.

With reference now to the drawings, and initially to FIG. 1, one embodiment of a modular support device is there shown in some considerable detail. The modular support device there illustrated comprises a pair of stackable support members or bolsters(an apical support member (10) atop a basal support member (15)), although it will be appreciated that several such bolsters may be stacked in mating engagement to achieve a desired height without departure from the invention.

Each bolster may be formed of a closed cell or open cell polymeric material, although for sanitation purposes certain closed cell materials may better achieve the objectives of the invention.

The material selected is preferably moldable into the novel shape that facilitates the stability of the device and must be capable of being cleaned and sterilized to be acceptable in a sterile environment.

It is within the contemplation of the invention that the bolster may be covered with a material as a means of enhancing the ability of the device to achieve such objectives as function in a sterile environment, sanitation and durability.

Figure 2:
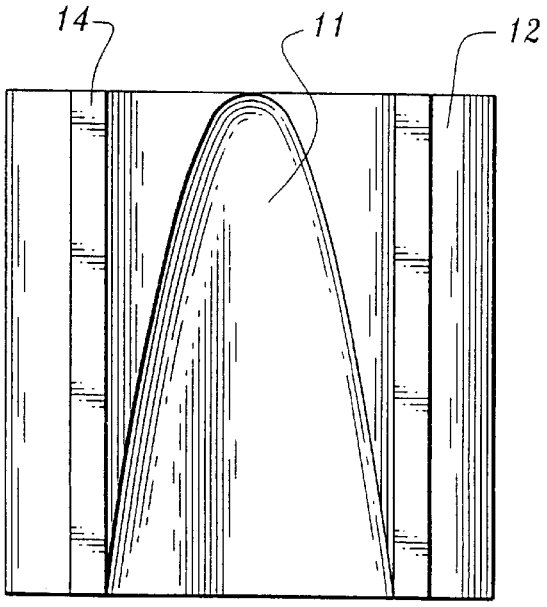
FIG. 2 is a top plan view of an apical support member of the present invention, depicting the support surfaces defined thereon. Noteworthy are the lowermost downstanding lateral margins (13) and the uppermost upstanding lateral margins (14), each of said downstanding lateral margins adapted to essentially overlay said uppermost lateral margin of an apical support member for frictional mating engagement and lateral support.

Each apical support member is essentially cylindrical shaped along its longitudinal axis, but truncated above and below to define the upper and lower surfaces on which adaptations are situated to enhance lateral support or frictional mating. Each is identically configured to engage an adjacent bolster so as to provide a stable support for an appendage. Referring, for example, to FIG. 2, the upper or top surface of the bolster presents a centrally disposed concave surface, which surface, in keeping with an aspect of the invention, is suitable for support of a body appendage such as an arm or a leg. Such appendages typically have rounded surfaces and, therefore, naturally gravitate to the center of the concavity of said surface, and, moreover, tend to settle in at the lowest point thereof, so that the appendage will have a greater tendency to remain relatively stationary.

Figure 3:
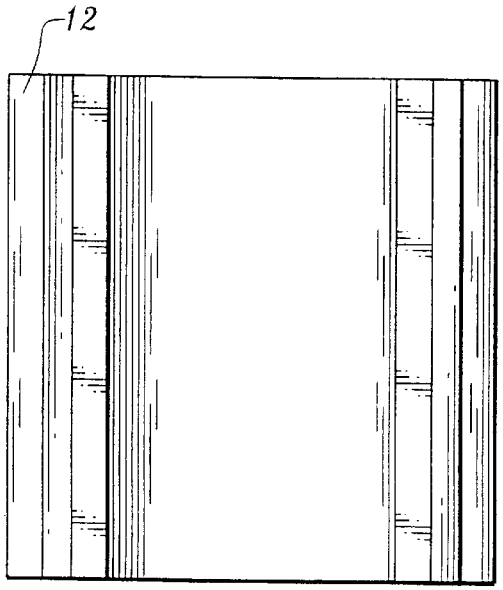
FIG. 3 is a view in the same mode as FIG. 2, but showing a bottom or undersurface of an apical support member, illustrating in plan view the stabilizing surfaces disposed thereon which, when engaged with an upper support surface of another support member beneath, contribute to the stabilization of the device.
Figure 4:
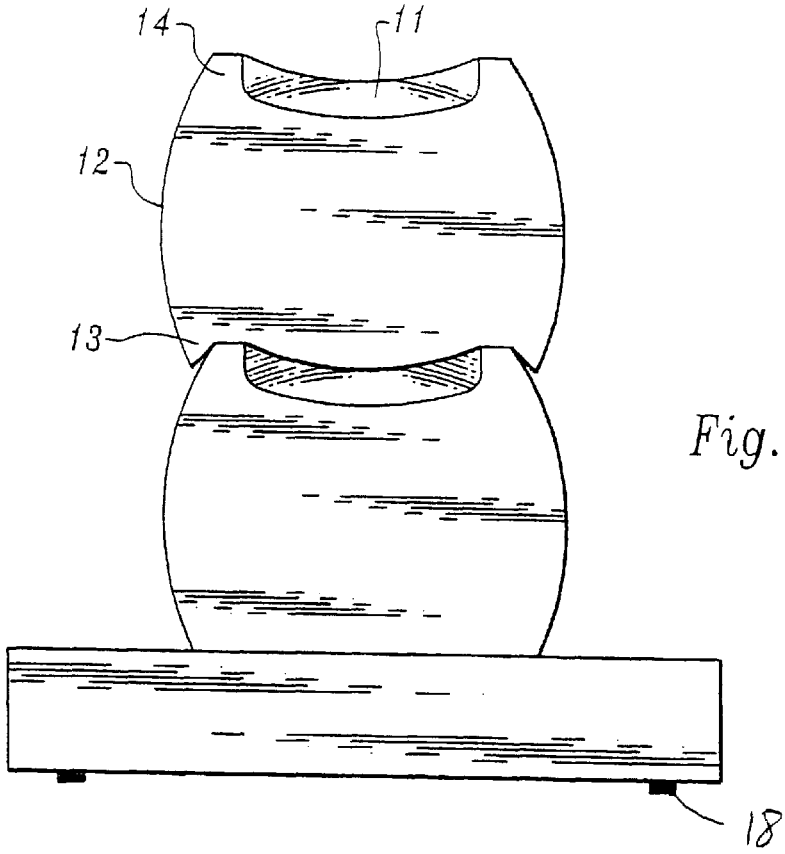
FIG. 4 is a front view of a device comprising an apical support member stacked atop a basal support member.
Figure 5:
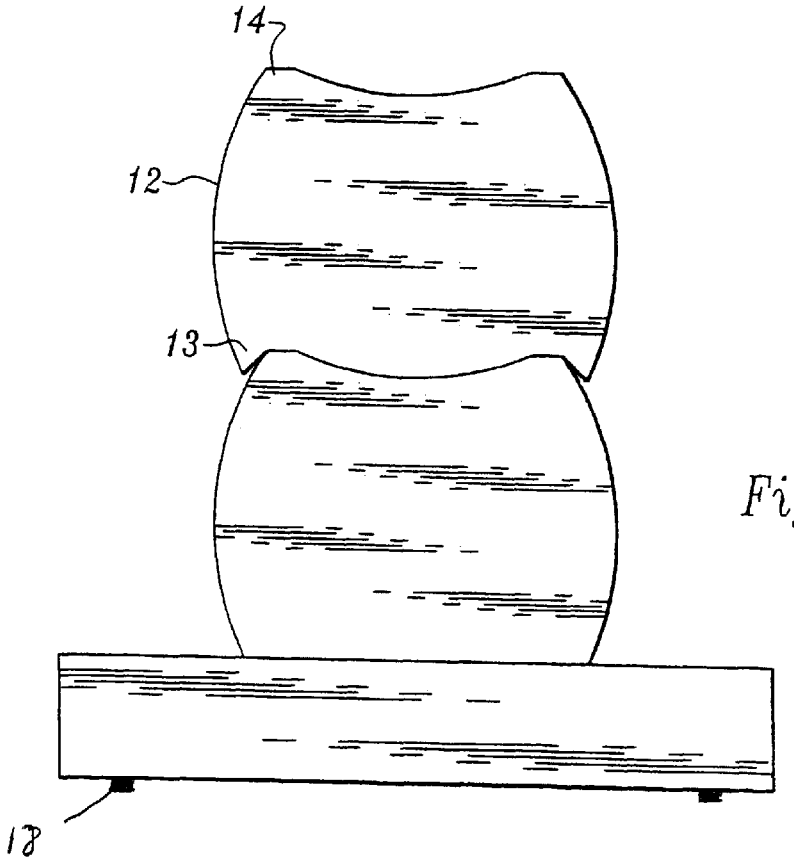
FIG. 5 is a rear view of a device comprising an apical support member stacked atop a basal support member, including downstanding touchpoints.
Figure 6:
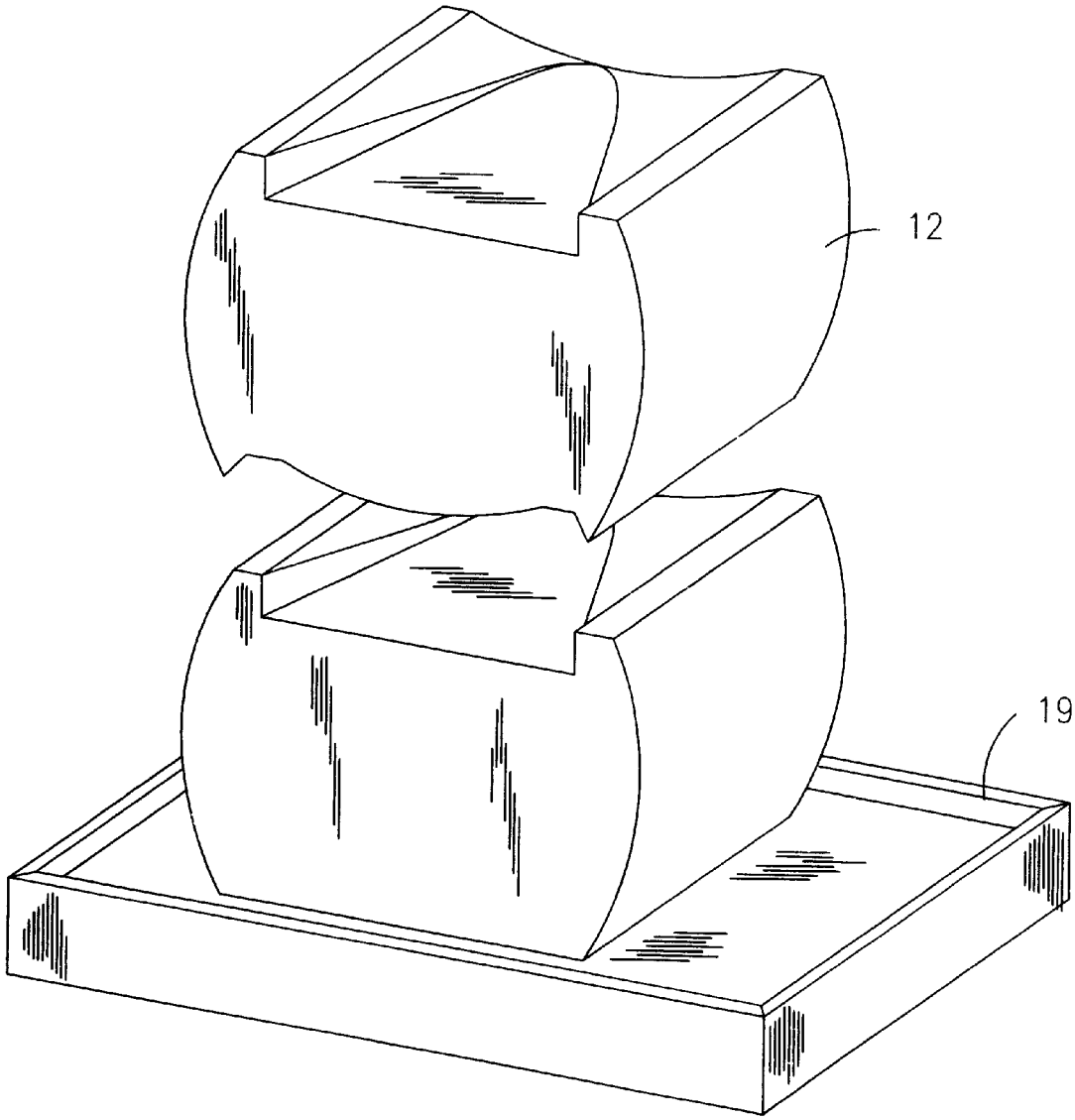
FIG. 6 is a pictorial view of a version of the device shown in perspective, including upstanding perimeter margins (19) defining a reservoir of a basal support member.
Figure 7:
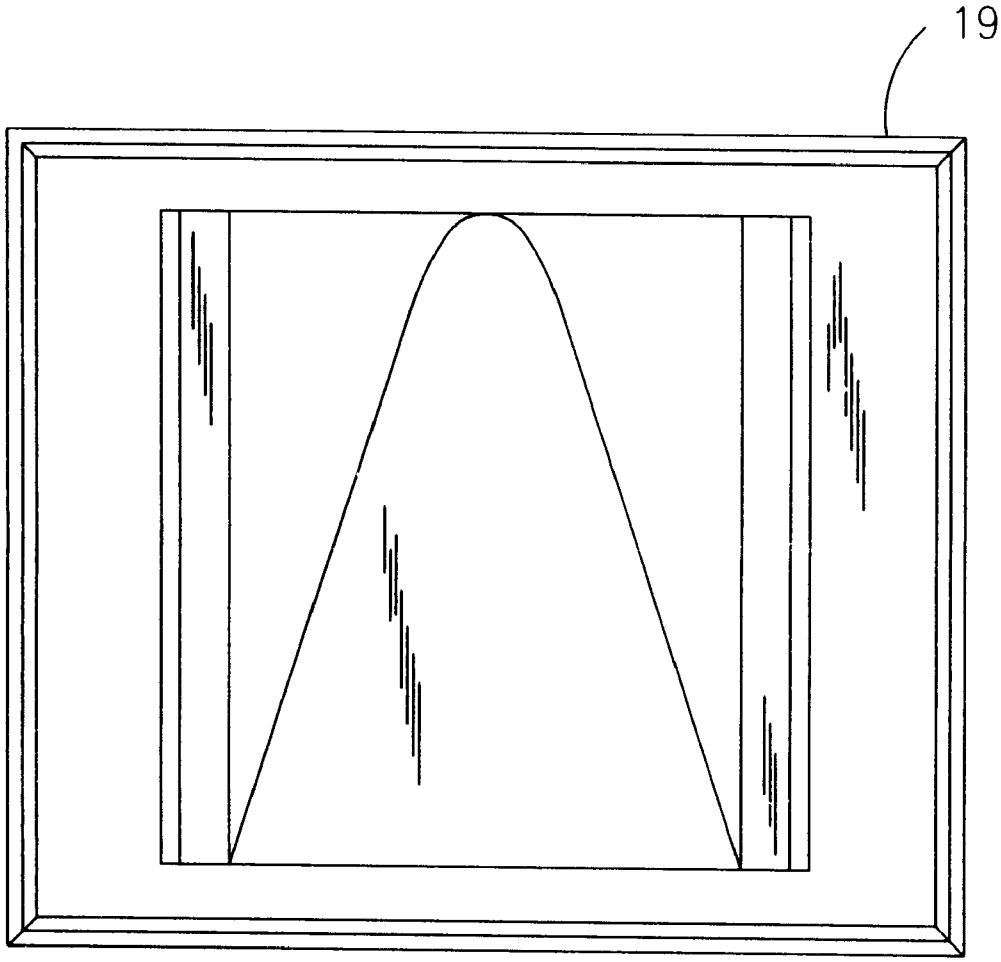
FIG. 7 is a top plan view of a basal support member as depicted in FIG. 6.

It is, however, an essential feature of the support of the present invention, that the stackable bolsters together comprise a stable support, and, to this end, and with reference to FIGS. 1 and 3, the lower, or undersurface, of the bolster is formed with longitudinally extending peripheral horns 13.

The terminus of each horn may be curved slightly inwardly so as to frictionally engage and embrace a mating bolster beneath, by pressing against its side walls 12 such that the inwardly directed pressure of the horns on the side wall tend to stabilize the stack and inhibit sideways displacement of one bolster relative to its engaged mate.

In order to enhance frictional engagement between associated bolsters in one version of the invention, the underside (or undersurface) includes a central portion which is convex and dimensionally compatible with the concave surface of the mating bolster below, such that when engaged there is optimum frictional engagement between the two.

In order to optimize stability, both the upper surface of the upstanding lateral margins (and/or the undersurface or the mated bolster above) may include an longitudinally extending, essentially flat surface or strip. The strips are dimensioned and positioned on the respective mating surfaces so as to be in face to face engagement as the bolsters are stacked to form the support.

Depending on the size of the support stack and the surface which supports it, a planar base 16 may be provided. The base may be integral with its basal support member, or separate therefrom and engageable therewith such as, for example, via a cavity or indentation sized to accept and mate frictionally with the undersurface of the basal support member immediately above. Such a base would be appropriate where the support extends from a surface other than that upon which the person whose appendage is being supported. It may not be necessary where the surfaces are the same. Clearly, however, the person constructing the support has discretion to use, or not use, the support as he or she sees fit in the best interests of achieving the objectives of the invention.

Aside from the aforementioned devices, the invention described herein may include a method of using an aforementioned device, comprising the steps of stacking of at least one apical support member atop at least one basal support member. This may include the steps of stacking a plurality of apical support member atop a basal-most support member, to attain the desired height.

Obviously minor variations in the structure which achieve the objectives set forth herein, may be employed without departure from the invention.

What is claimed is:

1. An appendage support device comprising:

a plurality of essentially stackable support members, each having an upper surface and a lower surface and at least two essentially opposite lateral sides;

each of said upper surfaces adapted to mate in frictional engagement with a lower surface of an adjacent support member, facilitating the stacking of at least one apical support member atop at least one basal support member, said lower surface being a substantially contiguous surface;

each of said support members having means on said lower surface for providing lateral support between itself and said basal support member.

2. An appendage support device described in claim 1 hereinabove, further comprising at least two essentially opposite longitudinal ends;

each of said lateral sides including curvature essentially convex to a common longitudinal axis of said support member, each of said convex lateral sides having a lowermost downstanding lateral margin and an uppermost upstanding lateral margin, each of said downstanding lateral margins adapted to essentially overlay said uppermost lateral margin of an apical support member for said frictional mating engagement and said lateral support.

3. An appendage support device described in claim 2 hereinabove, each of said upstanding lateral margins having an essentially horizontal upper face, each of said lower surfaces adapted to facilitate frictional mating engagement with said upstanding horizontal marginal face of an apical support member.

4. An appendage support device described in claim 3 hereinabove, at least an uppermost of said apical support members having an upper surface defining a regional concavity ergonomically sized to accept an appendage for support.

5. An appendage support device described in claim 4 hereinabove, wherein said regional concavity comprises an essentially parabolic indentation, the apex of said parabolic indentation terminating at one longitudinal end of said support member and almost flush with said uppermost upstanding margin, said parabolic indentation essentially deepening and widening while transversing along said longitudinal axis to an opposite longitudinal end of said support member.

6. An appendage support device comprising:

a plurality of essentially stackable support members, each having an upper surface devoid of any substantial peaks, and a lower surface and at least two essentially opposite lateral sides;

each of said upper surfaces adapted to mate in frictional engagement with a lower surface of an adjacent support member, facilitating the stacking of at least one apical support member atop at least one basal support member, said lower surface being a substantially contiguous surface;

each of said support members having means on said lower surface for providing lateral support between, itself and said basal support member;

the basal-most support member having a lower face comprising a plurality of downstanding touchpoints of suitable length to allow said basal support member to rest at an optimal orientation upon substratum.

7. An appendage support device of claim 6 hereinabove, wherein said basal-most lower face comprises an essentially planar base having a plurality of lateral dimensions exceeding the lateral dimensions of said lateral sides of said support member.

8. An appendage support device of claim 7 hereinabove, wherein said planar base includes upstanding perimeter margins defining a reservoir.

9. An appendage support device of claim 8 hereinabove, comprising construction materials selected from the group of firm foam material or rigid plastic or other polymeric material, and combinations thereof.

10. An appendage support device of claim 9 hereinabove, wherein each of said support members has:

a longitudinal dimension in the range of between about 4 inches and 24 inches long;

a vertical height in the range of between about 4 inches and 10 inches; and a width in the range of between about 4 inches and 10 inches.

11. An appendage support device of claim 10 hereinabove, wherein each of said support members has:

a longitudinal dimension of about 6 inches;

a vertical height of about 5 inches; and a width of about 8 inches.

12. An appendage support device of claim 11 hereinabove, wherein said basal-most support member includes a lower face comprising an essentially planar base having lateral dimensions exceeding the lateral dimensions of said lateral sides of said support member.

13. An appendage support device of claim 12 hereinabove, wherein said planar base includes upstanding perimeter margins defining a reservoir.

14. A method of using an appendage support device of claim 1 hereinabove, comprising the steps of stacking of at least one apical support member atop at least one basal support member.

15. A method of using an appendage support device described in claim 14 hereinabove, comprising the steps of stacking a plurality of apical support member atop a basal-most support member.

* * * * *